United States Patent [19]

Eckert

[11] 3,963,005

[45] June 15, 1976

[54] FUEL SUPPLY SYSTEM

[75] Inventor: Konrad Eckert, Stuttgart, Germany

[73] Assignee: Robert Bosch G.m.b.H., Stuttgart, Germany

[22] Filed: Oct. 2, 1974

[21] Appl. No.: 511,360

[30] Foreign Application Priority Data

Oct. 12, 1973 Germany ..... 2351203

[52] U.S. Cl. ..... 123/119 R; 123/139 AW; 261/50 A

[51] Int. Cl.[2] ..... F02M 7/18

[58] Field of Search ..... 123/119 R, 139 AW; 60/285, 276; 261/50 A

[56] References Cited

UNITED STATES PATENTS

| | | | |
|---|---|---|---|
| 3,680,535 | 8/1972 | Eckert et al. | 123/119 R |
| 3,730,155 | 5/1973 | Knapp | 123/119 R |
| 3,765,387 | 10/1973 | Knapp | 123/119 R |
| 3,809,036 | 5/1974 | Knapp et al. | 123/119 R |
| 3,835,828 | 9/1974 | Knapp | 123/139 AW X |
| 3,894,523 | 7/1975 | Stumpp | 123/139 AW |

*Primary Examiner*—Charles J. Myhre
*Assistant Examiner*—Tony Argenbright
*Attorney, Agent, or Firm*—Edwin E. Greigg

[57] ABSTRACT

A fuel supply system for internal combustion engines includes an air-flow measuring member located in the induction tube of the engine. The air-flow measuring member includes a lever which, when displaced, directly displaces a fuel metering control slide of a fuel metering valve assembly. This control slide is subjected to an opposing force exerted by pressurized fluid which may be fuel. The pressure of the control fluid is variable and is changed depending on temperature and on the composition of the exhaust gases. The temperature-dependent control of the fluid pressure is achieved by so disposing a bi-metallic spring in the pressure control valve that its changing force is added to the closing force of a primary control spring in the valve. A separate electric heater is provided to adapt the control process to the heating characteristics of the engine in a desired manner. The exhaust gas-dependent control of the fluid pressure is achieved by so disposing a secondary spring in the pressure control valve that its force is also added to the closing force of the primary control spring in the valve. The compression of the secondary spring may be altered by energizing an electromagnet under the control of the amplified signal from an exhaust gas monitor probe.

4 Claims, 1 Drawing Figure

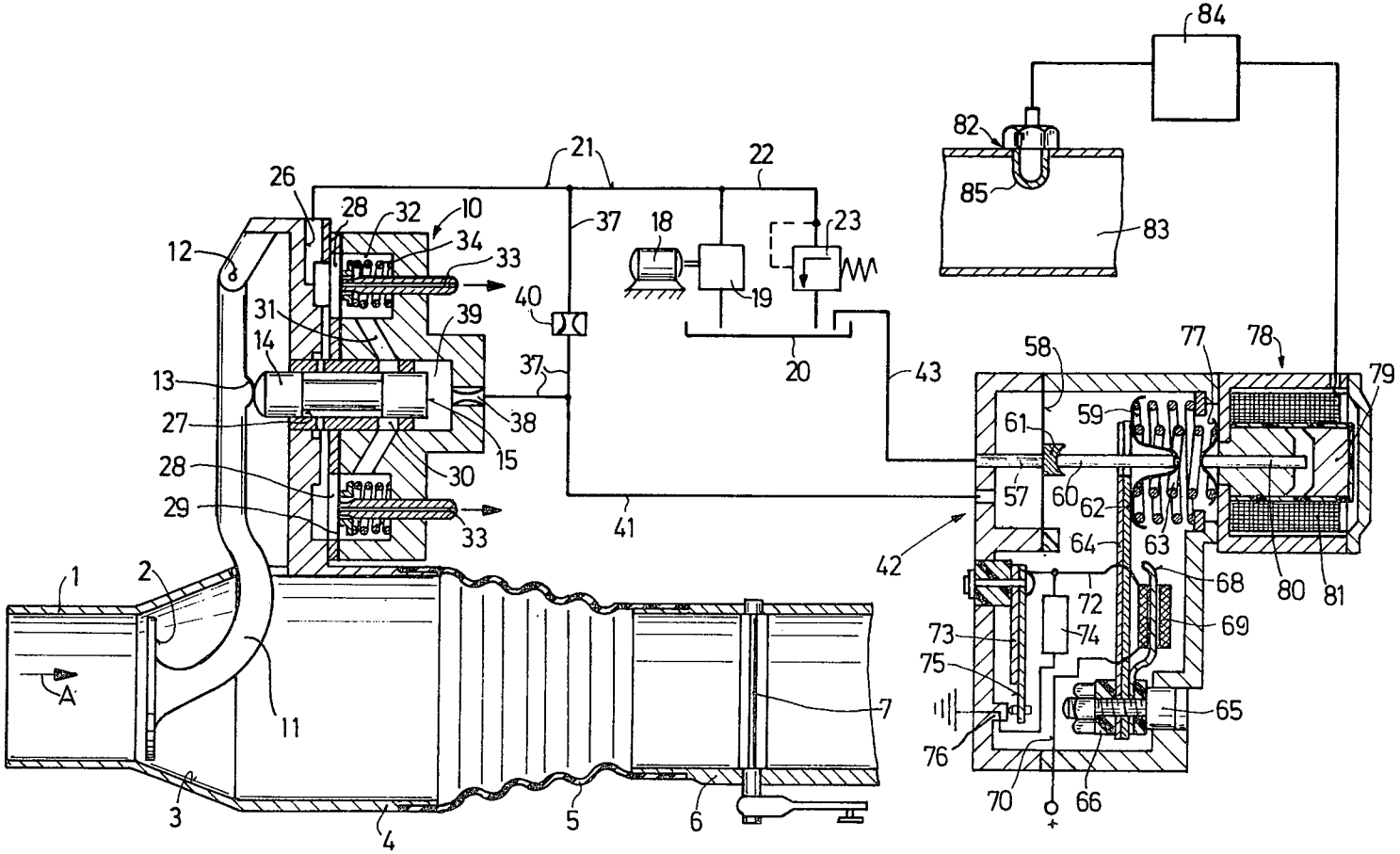
79
81
80
78
77
84
83
68
69
65
63
59
62
64
72
74
66
58
60
61
57
70
82
85
73
75
76
43
42
7
23
20
22
19
6
18
41
21
37
5
40
37
38
15
10
34
33
39
30
33
32
28
4
26
31
14
11
12
13
27
28
29
3
2
1
A

FUEL SUPPLY SYSTEM

BACKGROUND OF THE INVENTION

The invention relates to a fuel supply system for mixture compressing, externally ignited internal combustion engines which have an induction manifold and, disposed in series therein, an air-flow measuring member or sensor and an arbitrarily settable butterfly valve. The air-flow measuring member is displaced in proportion to the air flow against a restoring force and this displacement moves the movable part of a fuel quantity metering and distribution valve assembly disposed in the fuel line for the purpose of metering out a fuel quantity in proportion to the air quantity. The restoring force acting on the air-flow measuring member is produced by pressurized fluid delivered through a pressure line and this fluid impinges continuously and at constant, but arbitrarily changeable, pressure on a control slide which transmits the restoring force to the air-flow sensor. The pressure of the fluid may be changed by at least one pressure control valve subject to engine parameters. The pressure control valve contains a temperature-dependent, heatable control element embodied as a bi-metallic spring. The bi-metallic spring is thermally insulated with respect to its environment and is directly connected to a heat-conducting bracket which is electrically heated as soon as the engine is started. As long as the engine temperature is below the normal operating temperature, the bi-metallic spring opposes a control spring located within the pressure control valve.

It is the purpose of fuel injection systems of this type to establish favorable fuel-air mixtures automatically for all operational states of the internal combustion engine so as to cause as complete a combustion of the fuel as possible and to prevent, or at least to sharply reduce, the generation of toxic components in the exhaust gas while maintaining the highest possible performance of the lowest possible fuel consumption of the internal combustion engine. Achieving this goal requires very precise fuel metering adapted to the requirements of each operational state of the engine. Thus, for example, it must be possible to change the average fuel-air ratio in dependence on engine parameters, for example, on the engine temperature and the exhaust-gas composition.

In known fuel supply systems of this type, the fuel quantity is metered out as nearly proportional as possible to the air quantity flowing through the induction tube and the ratio of the metered-out fuel quantity to the air quantity can be altered by changing the restoring force acting on the air-flow measuring member in dependence on engine parameters. Separate pressure control valves govern the warm-up phase and the regulation of the air number, which is defined to be proportional to the air-fuel ratio and assumes the value $\lambda = 1.0$ stoichiometric air-fuel mixture.

OBJECT AND SUMMARY OF THE INVENTION

It is an object of the invention to provide a fuel supply system of the type described above which meets the stated requirements made of such a fuel supply system at the lowest possible constructional expenditure.

This object is attained, according to the invention, by providing a pressure control valve in which a secondary spring is disposed to function in parallel with the control spring and by providing that the compression of the secondary spring can be changed in dependence on engine parameters.

It is a particular, advantageous feature of the invention that the compression of the secondary spring can be changed in dependence on the oxygen content of the exhaust gas of the engine by an exhaust-gas sensor acting via an electromagnet.

It is a further advantageous feature of the invention that the electromagnet is a lifting solenoid controlled by an upper and lower threshold signal generated by the exhaust gas sensor.

BRIEF DESCRIPTION OF THE DRAWING

An exemplary embodiment of the invention is shown in the drawing whose single FIGURE is a cross-sectional side view of the fuel supply system and of the associated equipment according to the invention.

DESCRIPTION OF THE PREFERRED EMBODIMENT

The figure depicts a fuel supply system in which combustion air flows in the direction of the arrow A through an induction tube section 1 containing an air-flow measuring member 2 disposed within a conical tube section 3. The air then flows through an induction tube section 4 and a connecting hose 5 through an induction tube section 6 containing an arbitrarily settable butterfly valve 7. The air flows thence to one or several cylinders of an internal combustion engine (not shown). The air-flow measuring element 2 is embodied as a plate disposed transversely to the direction of the air flow and its motion is an approximately linear function of the air quantity flowing through the induction tube. If the restoring force acting on the measuring element 2 is constant and if the air pressure prevailing ahead of the measuring element is also constant, then the pressure prevailing between the measuring element and the butterfly valve 7 remains constant as well. The air-flow measuring element is used for the direct control of a fuel metering and distribution valve assembly 10. The motions of the measuring member 2 are transmitted by an attached lever 11, which pivots freely about a pivot point 12, causing a protrusion 13 to displace a control slide forming the movable valve member 14 of the fuel metering valve assembly 10. The face 15 of the control slide 14 remote from protrusion 13 is acted on by pressurized fluid which serves as the restoring force for the air-flow measuring member 2.

An electric motor 18 drives a fuel pump 19 which delivers fuel from a fuel tank 20 through a fuel line 21 to the fuel metering and distribution valve assembly 10. A line 22, which branches off from the line 21, includes a pressure limiting valve 23.

Fuel flows from line 21 to a channel 26 located in the housing of the metering and distribution valve assembly 10 to an annular groove 27 on the control slide 14 and also to several branchings to valve chambers 28, so that one side of diaphragm 29 is affected by the pressure of this fuel. The position of the control slide 14 determines the degree of overlap of the annular groove 27 with respect to fixed control slits 30 and thus determines the effective aperture of these slits. Each of the slits communicates through a channel 31 with a valve-chamber 32 separated by the diaphragm 29 from the associated chamber 28. From chamber 32, fuel may flow through injection channels 33 to the individual fuel injection valves (not shown) which are located in the induction tube of the engine in the vicinity of the engine cylinders. The diaphragm 29 is the movable member of a flat-seat valve which is normally held open by a spring 34 when the fuel supply system is inoperative. The diaphragm valves, each of which is formed by one chamber 28 and one chamber 32, have the effect that the pressure gradient across the metering apertures 27, 30 remain substantially constant independently of the effective aperture cross-section created by the overlap of the annular groove 72 over the control slits 30, i.e., independently of the fuel quantity reaching the injection valves. This consistancy insures that the path of the control slide 14 is proportional to the metered-out fuel quantity. During pivotal motions of the lever 11, the air-flow measuring member 2 is moved into the conical section 3 of the induction tube 1, so that the variable annular flow cross-section formed between the air-flow measuring member and the conical wall is proportional to the displacement of the air-flow measuring element 2.

The constant restoring force acting on the control slide 14 is produced by pressurized fluid which, in this case, is engine fuel. For this purpose, the line 21 branches off as line 37 and leads through a damping throttle 38 to a pressure chamber 39 into which extends the face 15 of control slide 14. Line 37 contains a preliminary throttle 40 which uncouples the fuel supply line 21 leading to the metering and distribution valve assembly 10 from the control pressure circuit 37, 41 associated with a pressure control valve 42. Downstream of the preliminary throttle 40, line 37 branches off into a line 41 leading to the pressure control valve 42. A fuel return line 43 carries fuel from the valve 42 back to the fuel tank 20 at zero gauge pressure. The pressure of the fluid which serves as the restoring force for the air-flow sensor 2 can be varied by the pressure control valve 42 in dependence on engine temperature as well as on the oxygen content of the exhaust gas. This valve 42 is embodied as a flat seat valve, with a fixed valve seat 57 and a diaphragm 58 which is biased in the direction of closing of the valve by a control spring 59 and a secondary spring 63. The closing force of control spring 59 and the coaxially disposed spring 63 is transmitted to the diaphragm 58 by a pin 60 which is lodged between the diaphragm 58 and said springs. The pin 60 is held in position by a support block 61 affixed to the diaphragm 58 and, at the other end, by a support cup 62 which also supports the control spring 59 and the coaxial secondary spring 63. Opposing the force exerted mediately by the spring support cup 62 is the free bifurcated end of a bi-metallic spring 64 the other end of which is fastened to the housing of the valve 42 by means of a bolt 65. An insulating disc 66 is located between the bolt 65 and the bi-metallic spring 64 to protect the bi-metallic spring against heat loss by thermal conduction to the housing of the pressure control valve. Disposed substantially parallel to the bi-metallic spring 64 is a heat conducting bracket 68 which is in thermally conducting contact with the bi-metallic spring 64 at their common fastening point.

An electrical heating element 69 is located on the heat conducting bracket 68 and one of its electrical leads 70 is connected to the positive pole of the electric circuit. The other electrical lead 72 may be connected to a ground contact 76 on the housing through a supplementary bi-metallic spring 73 fastened to, but electrically insulated form, the housing of the pressure control valve 42. The electrical circuit is closed by contact of the end 75 of spring 73 with the ground contact 76 located on the housing.

The electrical lead 72 is permanently connected to the ground contact 76 through a resistor 74 but this connection may be short-circuited by the supplementary bi-metallic spring 73.

The opposite end of the coaxially disposed secondary spring 63 remote from the support cup 62 is also supported by a support cup 77 which includes a central depression arranged to receive a member 80 moved by the armature 79 of an electromagnet 78. Thus, when the electromagnet 78 is energized, the compression of the secondary spring 63 may be increased. The electromagnet 78 is embodied as a lifting solenoid with a coil 81. It is cyclically activated by an exhaust gas sensor 82 disposed in the exhaust line 83 which generates an upper and a lower threshold signal for the threshold amplifier 84 which controls the activation of the electromagnet 78. The exhaust gas sensor 82 comprises a small tube 85, closed at one end, which may be made from a solid electrolyte, for example zirconium dioxide, by a sintering process. Both sides of the tube 85 are coated with evaporated microporous platinum layers which are provided with electrical contacts (not shown) and between which an electrical potential may exist. One side of the tube is exposed to the ambient air, and the other side is exposed to the exhaust gases of the motor vehicle. At the higher temperatures predominating in the exhaust gas, the solid electrolyte becomes a conductor for oxygen ions. Whenever the partial oxygen pressure of the exhaust gas is different from the partial oxygen pressure of the ambient air, an electrical potential difference occurs between the two platinum layers or between the two connecting clamps (not shown) whose magnitude is related to the air number $\lambda$. The output voltage of the exhaust gas sensor changes abruptly in the immediate vicinity of the point where the air number $\lambda$ equals unity (1.0), for, when $\lambda$ exceeds unity ($\lambda > 1.0$), the exhaust gas suddenly contains uncombusted oxygen. Because the output voltage of the oxygen sensor depends on heavily on the air number, $\lambda$, this type of sensor is extraordinarily well suited for controlling the fuel supply system according to the invention. When the air number, $\lambda$, is less than unity ($\lambda > 1.0$), the voltage of the oxygen sensor is high, whereas when the air number, $\lambda$, is greater than unity ($\lambda > 1.0$), the output voltage is small.

The above described fuel supply system functions as follows:

When the internal combustion engine is running, the fuel pump 19, driven by the electric motor 18, supplies fuel from the fuel tank 20 through line 21 to the metering and distribution valve assembly 10. At the same time, the internal combustion engine aspirates air through the induction tube 1, causing a certain displacement of the air-flow measuring member 2 from its normal position. Depending on the magnitude of the displacement of the measuring member 2, lever 11 displaces the control slide 14 which reveals a larger cross-section of the control slits 30. Because of the direct connection between the air-flow measuring member 2 and the control slide 14, the ratio of the metered-out fuel quantity to the air quantity remains constant as long as the characteristic behavior curves of these two members are sufficiently linear, which is a desired design condition. Thus, the fuel-air ratio would be constant throughout the entire operational domain of the engine. However, different operational states of the internal combustion engine require that the fuel-air mixture be richer or leaner and this may be achieved by changing the restoring force acting on the measuring element 2. For this purpose, the control pressure circuit 37, 41 contains the pressure control valve 42, which influences the fluid control pressure during the warm-up phase of the internal combustion engine and thus influences the mixture enrichment in a temperature-dependent manner until the operational engine temperature is reached. The fluid control pressure is determined by the valve-closing force transmitted to the diaphragm 58 from the control spring 59 and from the coaxially disposed secondary spring 63. When the engine temperature is below the operational temperature, the bi-metallic spring 64 acts upon the spring support cup 62 in opposition to the control spring 59 and the coaxial, secondary spring 63. For this reason, the net force transmitted to the diaphragm 58 is reduced. Immediately after the start-up of the engine, the electric heating element 69 heats the bi-metallic spring 64, reducing the force exerted by the bi-metallic spring 64 on the spring support cup 62. This time-dependent force reduction occurs in accordance with the quantity of heat transmitted to the bi-metallic spring 64. In order to make the reduction of the force of the bi-metallic spring 64 on the spring support cup 62 as linear as possible with respect to the heating of the internal combustion engine, the electric heating element 69 is not directly connected to the bi-metallic spring 64, but, instead, is located on a heat-conducting bracket 68 which is able to transmit heat to the bi-metallic spring 64 by conduction only at the common fastening point. By bending the heat conductor bracket, the amount of heat radiated to the bi-metallic spring 64 may be altered. This makes possible an advantageous adaptation of the time-dependence of the force of the bi-metallic spring in the warm-up phase to the heating characteristics of different internal combustion engines. The desired basic pre-tension can be set by the depth to which the bolt 65 is pressed into the housing of the pressure control valve 42 or by changing the spring characteristics of the control spring 59.

When the start-up temperatures are below 0°C, the heating of the bi-metallic spring 64 must be delayed. For this purpose, a resistor 74 is inserted in series with the current supply to the electric heating element 69. When the starting temperatures are normal, this resistor 74 is short-circuited by a supplementary bi-metallic spring 73 so that the electric heating element 59 receives the maximum energy. The drawing shows the bi-metallic spring 73 in the position in which it short circuits the resistor 74.

The coaxial secondary spring 63 is so disposed that it acts on the diaphragm 58 in the same direction and via the same pin 60 as does control spring 59. The compression of the secondary spring can be changed in dependence on the oxygen content of the exhaust gas. For this purpose, the end of the secondary spring remote from spring support cup 62 rests on a support cup 77 which may be displaced by the pin 80 urged by the armature 79 of an electromagnet 78. This displacement changes the compression of the secondary spring 63 and, hence, changes the pressure in the control pressure circuit 37, 41. The electromagnet 78 is cyclically actuated by the exhaust gas sensor 82 via the threshold amplifier 84. The fuel supply system tends to regulate a fuel-air mixture such that the air number $\lambda$ is approximately equal to unity ($\lambda = 1.0$), because it has been found that this ratio is particularly favorable. Thus if, for example, $\lambda > 1.0$, the exhaust gas suddenly contains uncombusted oxygen, the output voltage of the exhaust gas sensor decreases below the lower threshold value and the electromagnet 78 is deenergized. This relaxes the coaxial secondary spring 63 and reduces the pressure in the control pressure circuit 37, 41. That is equivalent to a reduction of the restoring force acting on the air-flow measuring member 2 and leads to an increased amount of metered-out fuel. If the fuel-air mixture becomes too rich, i.e., $\lambda > 1.0$, then the oxygen sensor voltage exceeds the upper threshold value and the electromagnet 78 is energized, increasing the compression of the coaxial secondary spring 63 which, in turn, results in an increase of the control pressure within the control pressure circuit 37, 41. This increases the restoring force and reduces the fuel quantity metered out by the control slide 14.

What is claimed is:

1. In a fuel supply system for mixture compressing, externally ignited internal combustion engines including: an induction tube; an air-flow measuring member disposed in the induction tube; an arbitrarily settable butterfly valve mounted within the induction tube in series relation with the air-flow measuring member; a fuel metering and distribution valve assembly containing a fuel metering control slide; connecting means connecting the air-flow measuring member to the control slide thereby transmitting the motion of said air-flow measuring member due to air flowing into the induction tube into axial motion of the control slide; means for conveying pressurized fluid to one side of said control slide so as to exert a force to oppose the axial motions of the control slide; and pressure control valve means including heatable, insulated bi-metallic spring means, electrically heated bracket means connected to said bi-metallic spring means for heating the same, control spring means, whereby the force of said bi-metallic spring means can oppose the force of said control spring means, the improvement comprising:

a. secondary spring means, disposed in said pressure control valve, in substantially parallel relation to said control spring means whereby the force of said bi-metallic spring means can oppose the force of said secondary spring means;

b. support means serving as a common support for both said control spring means and said secondary spring means; and c. means connected to said secondary spring means for directly varying the compression of said secondary spring means and indirectly varying the compression of said control spring means through said support means in dependence on the magnitude of one or more engine parameters, such that the magnitude of the force to oppose the axial motions of the control slide is increased when the compression of both the control spring means and the secondary spring means is increased and decreased when the compression is decreased.

2. An improved fuel supply system as defined in claim 1, wherein said means for varying the compression of said secondary spring means include:

a. an exhaust gas sensor disposed in the exhaust system of the engine;

b. an electromagnet operatively associated with said pressure control valve;

c. means connecting said exhaust gas sensor to said electromagnet for enabling the signal from said exhaust gas sensor to activate said electromagnet; and d. means whereby said electromagnet may mediately alter the compression of said secondary spring means.

3. A fuel supply system as defined in claim 2, wherein said electromagnet is a lifting solenoidal electromagnet.

4. A fuel supply system as defined in claim 3, the improvement further comprising means for activating said electromagnet when the signal from said exhaust gas sensor traverses one or more predetermined values.

* * * * *